United States Patent [19]

Uzunoglu

[11] 4,101,966

[45] Jul. 18, 1978

[54] 4-QUADRANT MULTIPLIER

[75] Inventor: Vasil Uzunoglu, Ellicott City, Md.

[73] Assignee: Communications Satellite Corporation, Washington, D.C.

[21] Appl. No.: 782,127

[22] Filed: Mar. 28, 1977

[51] Int. Cl.[2] ..... G06G 7/163

[52] U.S. Cl. ..... 364/841; 307/229; 307/304; 328/160; 333/18

[58] Field of Search ..... 235/194, 195; 328/160, 328/161, 167; 307/229, 230, 304, 279, 251; 333/18, 28 R, 70 T; 364/841, 849

[56] References Cited

U.S. PATENT DOCUMENTS

| | | | |
|---|---|---|---|
| 3,368,066 | 2/1968 | Miller et al. | 235/194 |
| 3,448,297 | 6/1969 | Rhodes | 235/194 X |
| 3,473,043 | 10/1969 | James | 235/194 X |
| 3,562,553 | 2/1971 | Roth | 235/194 X |
| 3,636,332 | 1/1972 | Nelson et al. | 235/194 X |
| 3,689,752 | 9/1972 | Gilbert | 235/194 |

*Primary Examiner*—Joseph F. Ruggiero
*Attorney, Agent, or Firm*—Sughrue, Rothwell, Mion, Zinn and Macpeak

[57] ABSTRACT

An operational amplifier uses p- and n-channel enhancement type MOSFETs as variable input resistors on the inverting and non-inverting legs, respectively, of the amplifier, and the sources and gates of the MOSFETs are tied together. By using $V_S$, the source-to-ground voltage, and $V_{GS}$, the gate-to-source voltage, as input signals, the device will perform 4-quadrant multiplication at operating frequencies as high as 400MHz.

6 Claims, 4 Drawing Figures

4-QUADRANT MULTIPLIER

BACKGROUND OF THE INVENTION

This invention relates generally to the field of multipliers, and more particularly to a 4-quadrant multiplier capable of operating at frequencies on the order of 400MHz.

Multipliers find a wide variety of potential uses, and are especially important in the present day art of signal processing. However, multipliers have not kept pace with the increase in operating speeds of other semiconductor devices and, as a consequence, we find many of our signal processors are limited by the operating frequencies of the multipliers used therein.

For example, consider the transversal-type adaptive equalizer shown in FIG. 1, the operation of which is well known in the prior art and will not be discussed in detail herein. The equalizer uses two sets of multipliers 10 and 12, the former acting as the weighting elements for the delay taps 14 and the latter acting as correlators for the control algorithm. It can easily be seen that the multipliers 10, 12 are an important part of the system and, although under certain conditions they can be simplified to single or two quadrant multipliers, for the purposes of this application both sets of multipliers will be assumed to be 4-quadrant multipliers.

It is often desirable to operate present day adaptive equalizers, such as that shown in FIG. 1, at frequencies from 10KHz to 10GHz. However, solid state multipliers presently available have bandwidths on the order of 70MHz and, due to the finite output impedances of semiconductor devices, the bandwidth will drop to below 10MHz when a load is added. There is, then, a need for higher frequency multipliers for use in high speed signal processing systems, such as the adaptive equalizer shown in FIG. 1.

Gain variation between individual multipliers in groups 10 and 12 will only affect the rate of convergence of the equalizer and the variation can be compensated for by using a separate error amplifier for each multiplier, rather than the single amplifier 16 shown in FIG. 1. Linearity will also only affect the rate of convergence. Therefore, gain and linearity requirements are quite flexible in the design of such high frequency multipliers.

One example of a high-speed multiplier device is discussed in U.S. Pat. No. 3,368,066. The device described therein uses field-effect transistors, operated in their triode region, as variable input resistors on either input terminal of a difference current amplifier. The drains of the FETs are tied together and each source is connected to a different amplifier input terminal. The voltage applied to the common drain terminal forms one input to the device and the voltage difference between the gate terminals forms the other input. The multiplication properties of the device are derived from the fact that, within the triode or "linear" region of operation, changes in gate voltage or drain voltage will cause proportional changes in drain current. Such a multiplier is unsatisfactory in that reversing the polarity of the drain voltage will cause the current amplifier to saturate, so that the device will only perform two-quadrant multiplication. Furthermore, although the device is referred to as a "fast" multiplier, the patentee states that it will operate at only up to 50MHz.

Another example of a prior art solid-state multiplier is given in U.S. Pat. No. 3,689,752. The multiplier described therein uses a pair of differential amplifiers in order to provide polarity discrimination. However, that device requires two amplifiers and several pairs of transistors and, in addition to having a high manufacturing cost, it will not achieve sufficiently high operating speeds.

SUMMARY OF THE INVENTION

Accordingly, it is an object of this invention to provide solid state 4-quadrant multipliers which are capable of operating at frequencies on the order of 400MHz.

The invention comprises an operational amplifier having p- and n-channel MOSFETs as variable input resistors on the inverting and non-inverting legs, respectively, of the amplifier. The sources of the MOSFETs are tied together, as are the gates, and the device will perform as a 4-quadrant multiplier having the common source and common gate terminals, respectively, as the two input terminals, and will be band limited only by the operating frequencies of the operational amplifier and MOSFETs, respectively. The MOSFETs may be operated at frequencies as high as 500MHz and, with the flexible requirements on the gain factor and overall linearity, balanced amplifiers with operating frequencies as high as 500MHz can be realized. Therefore, a solid state 4-quadrant multiplier according to the present invention can be operated at frequencies as high as 400MHz.

DETAILED DESCRIPTION OF THE PREFERRED EMBODIMENT

Figure 1:
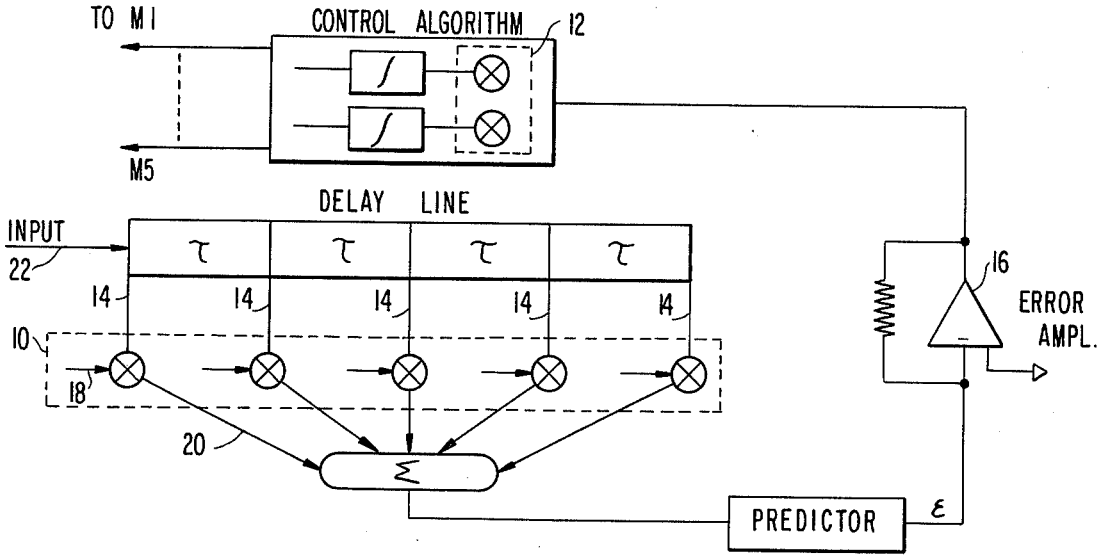
FIG. 1 PRIOR ART
FIG. 1 is a block diagram of a transversal-type adaptive equalizer well known in the prior art.

FIG. 1, as discussed hereinabove, is a block diagram of a transversal-type adaptive equalizer in which the 4-quadrant multiplier according to the present invention may be used. It will be understood by those skilled in the art that the example of a transversal-type adaptive equalizer is given for illustrative purposes only, and that there will be various other uses for the high frequency 4-quadrant multiplier according to the present invention.

Referring specifically to the group 10 of multipliers which form the tap weighting elements of the equalizer, each multiplier has a pair of inputs 14 and 18 and a corresponding output 20. In order to equalize high frequency signals appearing at input terminal 22, the multipliers may be required to operate at frequencies as high as a GHz, a rate which is significantly higher than the operating frequencies of presently available multipliers.

Figure 2:
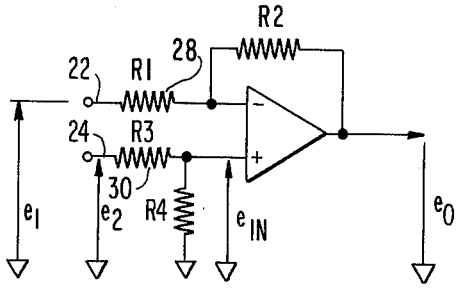
FIG. 2 PRIOR ART
FIG. 2 is a schematic diagram of an ideal operational amplifier circuit well known in the prior art.

Referring now to FIG. 2, there is shown a schematic diagram of an ideal operational amplifier circuit which will aid in the understanding of the theoretical operation of the multiplier according to the present invention.

It is well known in the art that the following relationships are valid for the ideal operational amplifier circuits shown in FIG. 2;

$$e_{in} = e_2 \frac{R_4}{R_3 + R_4} \quad (1)$$

$$\frac{e_1 - e_{in}}{R_1} = \frac{e_{in} - e_o}{R_2}. \quad (2)$$

Combining (1) and (2) we have $$e_o = \frac{R_4}{R_3}\left(\frac{1 + \frac{R_2}{R1}}{1 + \frac{R_4}{R_3}}\right)e_2 - \left(\frac{R_2}{R_1}\right)e_1. \quad (3)$$

Figure 3:
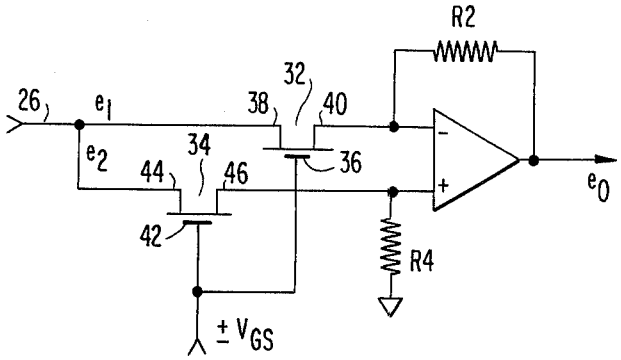
FIG. 3 is a schematic diagram of a high frequency 4-quadrant multiplier according to the present invention.

Keeping in mind the above relationships, refer now to FIG. 3, wherein a schematic diagram of the preferred embodiment of the 4-quadrant multiplier according to the present invention is shown. The multiplier is similar in all respects to the circuit of FIG. 2 except that the two input terminals, 22 and 24 in FIG. 2, have been tied together to form one input terminal 26 and the two input resistors, 28 and 30 in FIG. 2, have been replaced by p-channel and n-channel enhancement-type MOSFETs 32 and 34, respectively. As is well known in the art, a negative voltage at the gate 36 of the p-channel MOSFET 32 will form a channel having resistance R1 between input terminal 38 and output terminal 40. Likewise, a positive voltage n-channel MOSFET 34 will form a channel having resistance R3 between input terminal 44 and output terminal 46 of the n-channel MOSFET 34.

Figure 4:
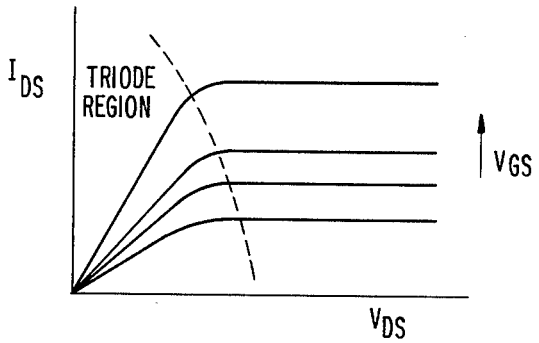
FIG. 4 is a graph of the performance characteristics of the MOSFETs used in the multiplier of FIG. 3.

If the MOSFETs are operated in the triode region illustrated in the graph of FIG. 4, they will operate as complimentary voltage-dependent resistors, i.e., only one MOSFET will conduct at any given time depending on the polarity of $V_{GS}$, and the resistance of the conducting MOSFET will depend on the magnitude of $V_{GS}$.

The on-resistance between the source and drain of a MOSFET can be expressed as $$R_{ON} = \frac{V_{DS}}{I_{DS}} = \frac{K}{V_{GS} - V_T + \frac{V_{DS}^2}{2}} \quad (4)$$

where $V_{DS}$ = drain to source voltage
$I_{DS}$ = drain to source current
$V_T$ = threshold voltage
$V_{GS}$ = gate to source voltage
$K$ = constant determined by the geometry of the device.

If the device is operated in its triode region as shown in FIG. 4, then $V_T$ and $V_{DS}$ can be considered much smaller than $V_{GS}$ so that Equation (4) becomes $$R_{ON} = K/V_{GS}. \quad (5)$$

Higher $V_{GS}$ will result in lower $R_{ON}$ and K and $V_{GS}$ will always have the same polarity in order that $R_{ON}$ be positive. In terms of $R_3$ or $R_1$, Equation (5) can be written as $$R_1 = \frac{K_P}{V_{GS}} \text{ or } R_3 = \frac{K_N}{V_{GS}} \quad (6)$$

where $K_P$ and $K_N$ are K for p- and n-channel MOSFETs, respectively.

For positive $V_{GS}$, p-channel MOSFET 32 will not conduct and R1 $\rightarrow \infty$ so that the second term in expression (3) becomes zero. Similarly, for negative $V_{GS}$ the first term will be zero. Mathematically the 4-quadrant multiplier output for positive $V_{GS}$ can be expressed as $$e_o = \frac{R_4}{R_3}\left(\frac{1}{1 + \frac{R_4}{R_3}}\right)e_2. \quad (7)$$

As $R_3 = K_N/V_{GS}$, Eq. (7) become $$e_o = \frac{R_4 V_{GS}}{K_N}\left(\frac{1}{1 + \frac{V_{GS}R_4}{K_N}}\right)e_2. \quad (8)$$

For $|(R_4/K_N)V_{GS}| << 1$, Eq. (8) becomes $$e_o = (V_{GS}R_4/K_N)\, e_2. \quad (9)$$

Similarly, for $V_{GS}$ negative the output becomes $$e_o = (-R_2/R_1)\, e_1 \quad (10)$$

As $R_1 = K_P/V_{GS}$, Eq. (10) becomes $$e_o = \frac{-R_2}{K_P} V_{GS} e_1. \quad (11)$$

Since the conductance channel input terminals 38 and 44 are tied together, $e_2$ and $e_1$ in Equations (9) and (11), respectively, are equal and may be designated merely by $e_1$. Also, we know from Equation (5) that $K_P$ must be negative for negative $V_{GS}$ and, therefore, the quantity $(-R_2/K_P)$ is a positive constant. By selecting circuit components so that the magnitudes of $R_4/K_N$ and $R_2/K_P$ are both equal to a fixed value M, Equations (9) and (11) for positive and negative $V_{GS}$, respectively, may be rewritten as $$e_o = M\, V_{GS}\, e_l \quad (12)$$

It will be seen that Equation (12) describes a 4-quadrant multiplier having inputs $V_{GS}$ and $e_1$. The operating frequency of the above multiplier is limited only by the operational amplifier and the two MOSFETs. The latter may be operated at frequencies as high as 500MHz, and operational amplifier may have operating frequencies on the order of 200MHz. Moreover, when the multipliers are to be used in a device such as a transversal type adaptive equalizer where the requirements of gain factor and overall linearity are flexible, balanced amplifiers with operating frequencies close to 500MHz can be realized. This is a substantial improvement over multipliers which are presently available.

While I have shown and described one embodiment of my invention, it will be apparent to those skilled in the art that many changes and modifications may be made without departing from my invention in its broadest aspects. It is, therefore, to be understood that the appended claims are intended to cover this and all other such modifications and changes as fall within the true spirit and scope of my invention.

What is claimed is:

1. A high frequency 4-quadrant multiplier for receiving two input signals and providing an output proportional to the product of said input signals, and multiplier comprising:

an operational amplifier having first and second input terminals and an output terminal for providing the output of said 4-quadrant multiplier;

variable first and second resistance elements each having an input terminal, an output terminal and a control terminal, the input terminals of said resistance elements being coupled together for receiving a common input signal and the control terminals of each said resistance element being coupled together for receiving a common control signal, the resistance between the input and output terminals of each said resistance element varying in response to said common control signal, the output terminals of said variable first and second resistance elements being coupled to the first and second operational amplifier input terminals, respectively, said common input signal and said common control signal forming the input signals to said 4-quadrant multiplier.

2. A high frequency 4-quadrant multiplier according to claim 1 further comprising a third resistance element coupled between the first input terminal of said operational amplifier and the output terminal of said operational amplifier and a fourth resistance element coupled between the second input terminal of said operational amplifier and a reference voltage.

3. A high frequency 4-quadrant multiplier according to claim 2 wherein the first and second input terminals of the operational amplifier are the inverting and non-inverting input terminals, respectively, of said amplifier.

4. A high frequency 4-quadrant multiplier according to claim 3 wherein said variable first and second resistance elements are complimentary.

5. A high frequency 4-quadrant multiplier according to claim 3 wherein said variable first and second resistance elements are first and second enhancement type MOSFETs and wherein said control terminals are the gates of said MOSFETs.

6. A high frequency 4-quadrant multiplier according to claim 5 wherein said first and second MOSFETs are p-channel and n-channel MOSFETs, respectively.

* * * * *

UNITED STATES PATENT AND TRADEMARK OFFICE

CERTIFICATE OF CORRECTION

PATENT NO. : 4,101,966

DATED : July 18, 1978

INVENTOR(S) : Vasil UZUNOGLU

It is certified that error appears in the above-identified patent and that said Letters Patent are hereby corrected as shown below:

Column 3, line 11 - Eq. (3) delete "Rl" insert -- $R_1$ --

Column 5, line 3 - delete "and" insert -- said --

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*